United States Patent [19]

Gyomrey

[11] 4,412,622

[45] Nov. 1, 1983

[54] TELESCOPING STRUT CRANE

[75] Inventor: Karl M. Gyomrey, Belmont, England

[73] Assignee: Coles Cranes Limited, England

[21] Appl. No.: 418,134

[22] Filed: Sep. 15, 1982

Related U.S. Application Data

[63] Continuation of Ser. No. 179,616, Aug. 18, 1980, abandoned.

[30] Foreign Application Priority Data

Aug. 17, 1979 [GB] United Kingdom ..... 7928797

[51] Int. Cl.[3] ..... B66C 23/42

[52] U.S. Cl. ..... 212/187

[58] Field of Search ..... 212/175, 179, 182, 186, 212/187, 188; 414/742

[56] References Cited

U.S. PATENT DOCUMENTS 3,059,781 10/1962 Bender et al. ..... 212/187 X 3,399,785 9/1968 Mork ..... 212/187 X

*Primary Examiner*—Robert G. Sheridan

*Attorney, Agent, or Firm*—Townsend and Townsend

[57] ABSTRACT

A mobile crane which has the advantages of both a telescopic cantilever jib and of a lattice strut or lightweight jib. This is achieved in accordance with the invention by providing a powered link which swings the foot of the base section of the telescopic jib between a forward position for use and a rearward position for stowage.

20 Claims, 5 Drawing Figures

24
28
32
24
34
10
26
48
44
38
36
46
6
42
4
40
12
8

TELESCOPING STRUT CRANE

This is a continuation of application Ser. No. 179,616, filed Aug. 18, 1980 now abandoned.

This invention relates to cranes and in particular to mobile cranes, i.e. cranes which are mounted on or built into, a vehicle to enable the crane to be moved at will.

Mobile cranes normally have their crane jib pivotally mounted on a turntable enabling the jib to be slewed to pick up loads in an arc around the vehicle centered on the pivot of the turntable.

Mobile cranes have hitherto been of two types, one type having a telescopic cantilever jib and the other type having a lattice strut jib.

Cranes of the first type, in which the telescopic cantilever jib is lifted and lowered by a ram acting between the jib and the vehicle, have the jib pivot positioned towards the rear of the vehicle which enables a fairly long telescopic jib base section to be used since, when stowed in a substantially horizontally position above the vehicle, the base section extends along the length of the vehicle. However, the jib assembly has to be heavy in order to withstand the loads applied thereto due to the cantilever effect. This is a factor which limits the load which may be lifted for a given gross vehicle weight.

Cranes of the second type in which the lattice structure is light compared to a cantilever telescopic jib, normally have their strut, or lattice jib, pivoted adjacent the front of the vehicle so as to enable the head of the jib to be supported by tie ropes from a point further to the rear of the vehicle which is necessary to enable the light lattice structure to carry the required load and to be "derricked" up and down.

Whilst cranes of this second type have a lighter jib than cranes of the first type, enabling a heavier counterweight to be employed and heavier loads to be lifted for a similar gross vehicle weight, they have a disadvantage, namely, that due to the pivotal position of the jib on the vehicle, the jib sections cannot be telescoped and then the base section be lowered into a travelling position on the vehicle. This is because as the base section is pivoted downwardly for transportation, it would overhang the front of the vehicle to an unacceptable amount. The result of this is that with lattice strut jib cranes, the various jib sections have to be assembled and dismounted manually by specialised workers once a crane has arrived at a desired working position and subsequently before the crane can be again moved. This is both costly and time consuming and mitigates against the advantages of having a mobile crane.

A mobile crane in accordance with this invention comprises a telescopic jib (which is preferably of lattice or lightweight box section) which operates as a strut and the head of which, in use, is supported by tie "ropes," its foot then being pivoted adjacent the front of the vehicle or adjacent the front end of the vehicle turntable, means being provided to move the foot of the jib rearwardly along the crane vehicle for stowage.

Such a crane has the advantages both of a telescopic cantilever jib crane, i.e. a crane in which the strut need not be erected manually, and which the base section can be carried on the vehicle and a crane of the second or strut jib type, in which the jib is of light weight, enabling a heavier load to be carried with greater stability.

For example, with a standard cantilever jib, assuming a vehicle having a 50 ton gross weight, the chassis having a 20 ton weight, and the crane, jib and superstructure weighing 30 tons, 18 tons is usually taken up by the jib weight leaving 12 tons for the counterweight and the remainder of the superstructure. If, as is possible with a crane of the invention, the weight of the cantilever jib is reduced to, say, 10 tons without losing strength because the head of the jib is supported by tie ropes, then the 8 ton saving on jib weight can be used to increase the weight of the counterweight giving both an increase in stability and an increase in the load which can be carried by the crane.

The telescopic jib sections may be pinned at their fully extended position and/or at selected partly extended positions, so as to produce a stronger construction.

The means for moving the foot of the jib along the length of the vehicle may comprise a ram pivotally mounted between a point on the vehicle or preferably the jib super structure/turntable, and a swing link, one end of the swing link being pivotally connected to the foot of the jib and the other end to the crane vehicle or superstructure/turntable, the arrangement being such that on operation of the ram, with the jib in the erected position, the swing link, and hence the foot of the jib, is caused to move rearwardly from its operating position whilst the base section of the telescopic jib is lowered by the tieropes to a position in which it lies along the vehicle possibly overhanging the front and rear thereof by a predetermined permitted amount.

The tie "ropes" for the jib may be of fixed length and be passed around a pulley at the head of a derrick mast, the lower end of the mast being pivotally connected to the superstructure/vehicle having its angular position determined by a ram pivotally connected between the derrick mast and the vehicle. Operation of the ram alters the angle of the derrick mast to the vehicle, causing the tie ropes to move the head of the jib either upwardly or downwardly.

As the foot of the jib is moved rearwardly from the operating position, the derrick mast ram also operates to pivot the mast in a direction to lower the head of the jib so that a smooth stowage of the jib is achieved. During this operation, the front portion of the base section of the jib may be supported by a hydraulically operated jib support bracket mounted at the front of the vehicle. When the jib is in its correct stowed position, the derrick ram is preferably pressurised to a low pressure to ensure that the tie ropes and mast are stowed taut and correctly in the lowest position pivoted back towards the rear of the vehicle.

To ensure best weight distribution during normal travelling, it is preferable that the counterweight is transported at the front of the chassis of the vehicle but at the same time the counterweight should be easily and quickly re-attachable for normal working conditions. This may be achieved by having a counterweight stowage platform at the front of the chassis of the vehicle above the engine, the platform being equipped with hydraulic cylinders so that the weight may be lifted from the stowed platform and held clear until the superstructure is slewed to its normal travelling position.

The invention will now be further described by way of example with reference to the accompanying drawings in which.

Figure 1:
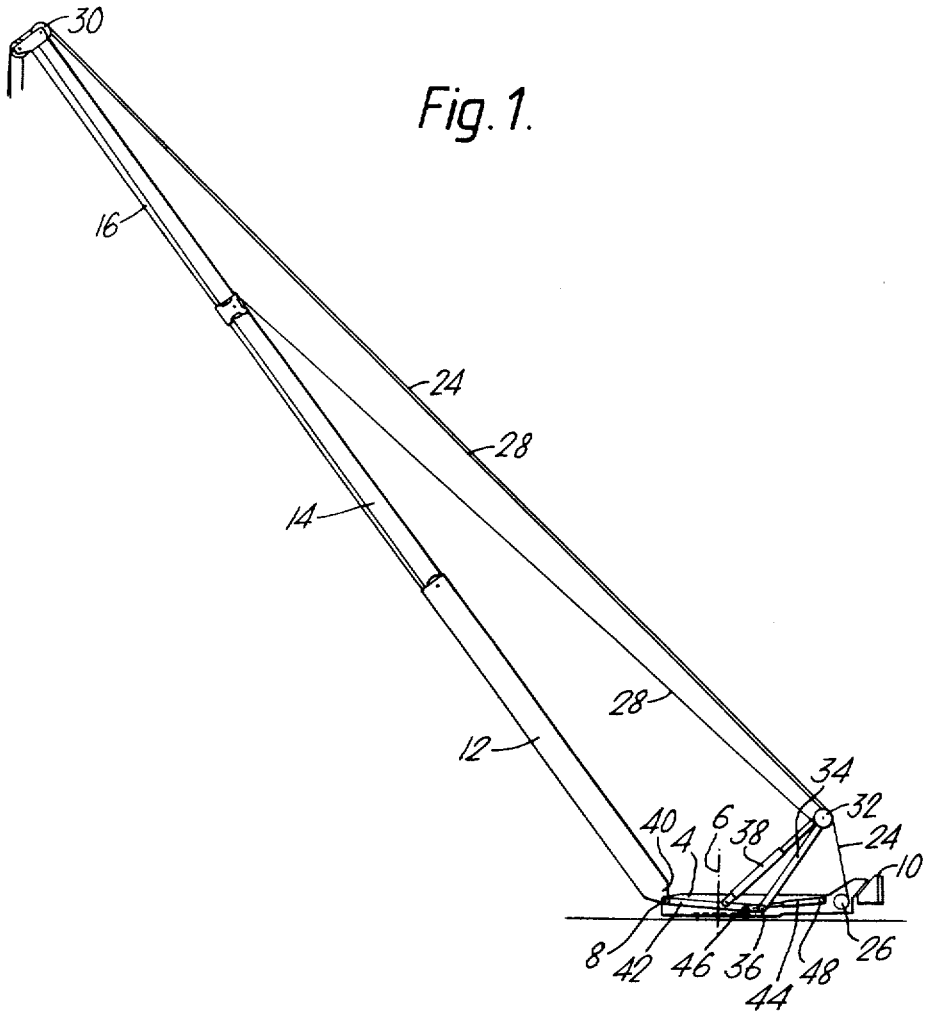
FIG. 1 is a diagrammatic view of the superstructure of a mobile crane in accordance with this invention showing the telescopic jib in the erected position.
Figure 2:
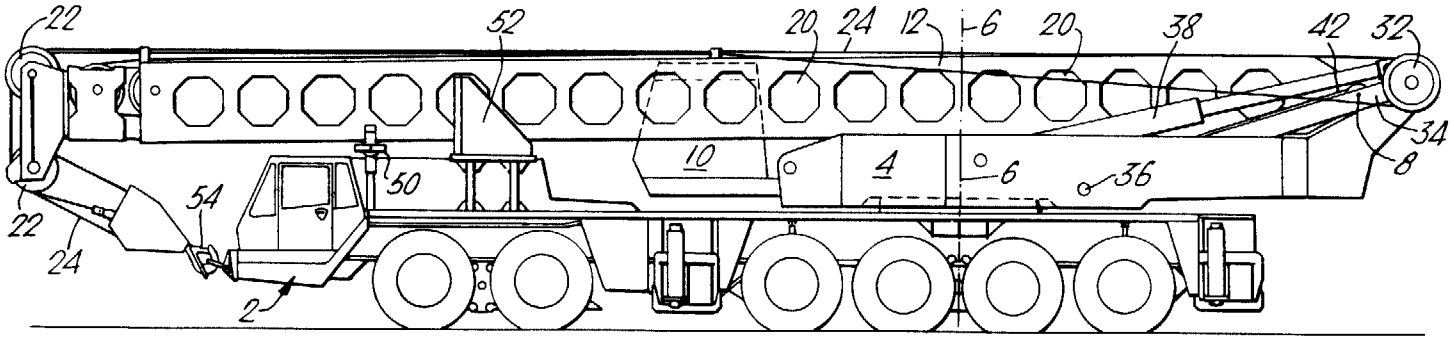
FIG. 2 is a side elevation of the mobile crane showing the telescopic jib in its travelling position.

Referring to the drawings, the mobile crane comprises a standard vehicle generally indicated at 2 in FIG. 2 carrying a turntable/superstructure 4 pivotally mounted to rotate relatively to the body of the vehicle about an axis indicated by the dot and dash line 6. When the crane jib is in the erected position shown in FIG. 1, its foot is pivoted at 8 at the front of the turntable, the turntable carrying at its rear end, a counterweight 10.

The jib comprises three telescopic sections, namely, a base section 12, an intermediate section 14 and a head section 16. The sections are of lightweight or lattice construction as can be seen by the cut-outs 20 of the base section 12 (as seen in side elevation in FIG. 2). These cut-outs or lattice structure are conventional and are not illustrated in FIGS. 1, 3, 4 or 5.

As is conventional, the top of the head section 16 carries pulleys 22 around which the lifting ropes 24 pass, the lower end of this rope 24 being wound around a winch 26 on the turntable 4. As the lightweight construction of the telescopic jib is not sufficiently strong to act as a cantilever when carrying a heavy load, it is provided with supporting tie "ropes" 28 which pass around one pulley 30 at the top of the head section 16 and then around a pulley 32 carried by a "derrick" mast 34 which has its lower end pivoted at 36 to the turntable 4. The tie ropes are of fixed length and both ends are secured to the crane jib in the manner described in our co-pending application Ser. No. 179,360, now U.S. Pat. No. 4,363,413, filed co-terminously herewith.

When the lightweight jib sections are in their extended position as shown in FIG. 1, they may be pinned together either manually or as described in our co-pending application Ser. No. 179,360 so as to increase the load which can be carried by the jib. These pins can be withdrawn automatically when the jib is to be collapsed.

The angle of the derrick mast 34 to the vehicle, which determines, through the tie ropes 28, the angle of the jib, can be altered to luff or lower the jib by means of a ram 38 pivotally connected between the turntable 4 and the head of the mast 34.

The foot 40 of the base section 12 of the jib which during use is pivoted at 8 to the front portion of the turntable, is pivotally carried at one end of a swing link 42 the other end of which is pivoted at 36 to the turntable. The movement of the swing link 42 is controlled by a hydraulic ram 44 pivotally connected between a point 46 located between the ends of the swing link 42, and a point 48 on the turntable.

Figure 3:
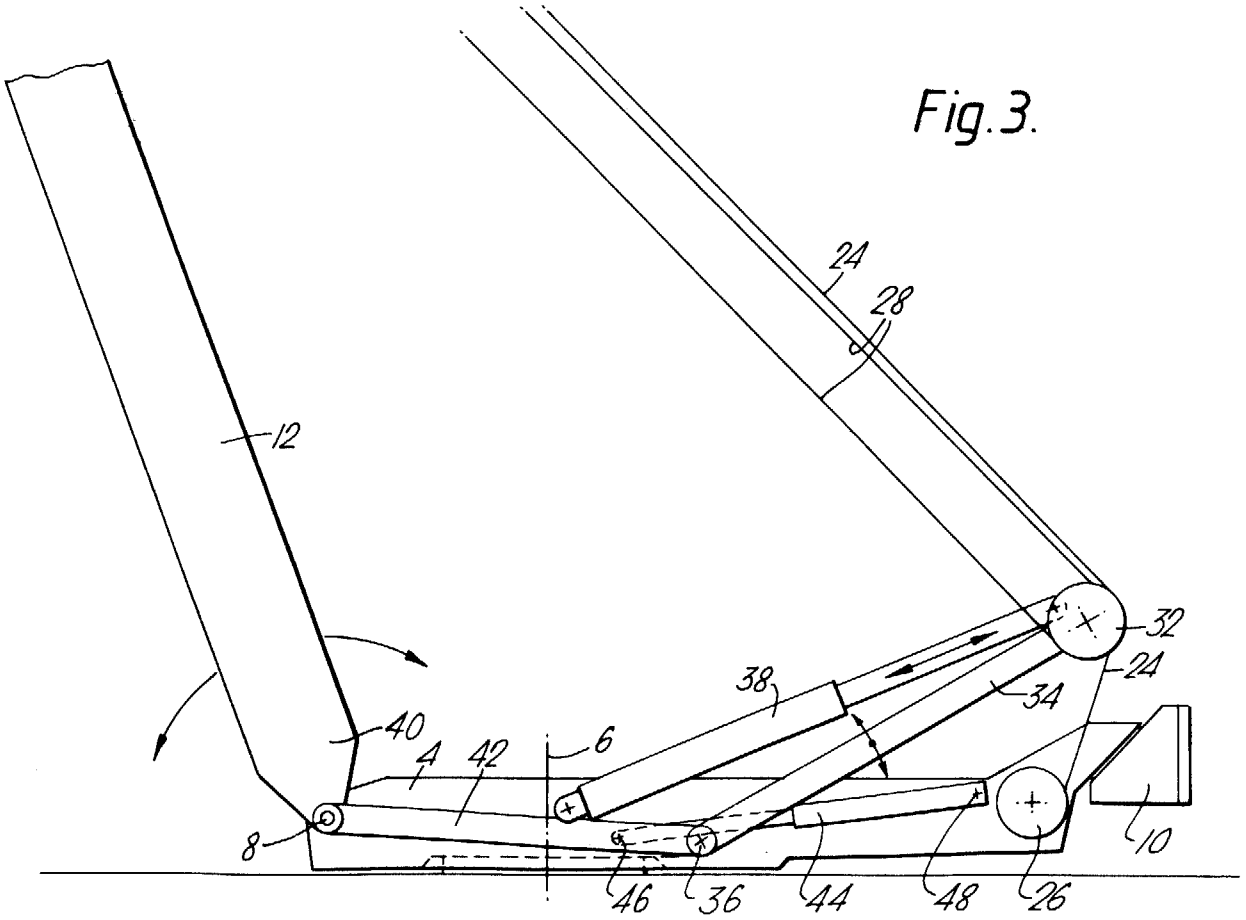
FIG. 3 is a diagram of the rear end of the base section of the jib showing this in the operating position of FIG. 1.

When it is desired to lower the jib from its erected position as shown in FIGS. 1 and 3, the pins holding the jib sections in their extended position are withdrawn and the uppermost section 16 and mid section 14 are telescoped down into the base section 12. The fixed length tie ropes 28, during this operation, are kept in a supporting position with the additional length generated by the telescoping of the sections being automatically taken-up within the sections as fully described in the specification of our co-pending application Ser. No. 179,360 filed co-terminously herewith.

The means for contracting and expanding the telescopic sections may be conventional or may be that using a single chain as is described in the specification of our co-pending application Ser. No. 179,360 filed co-terminously herewith.

Figure 4:
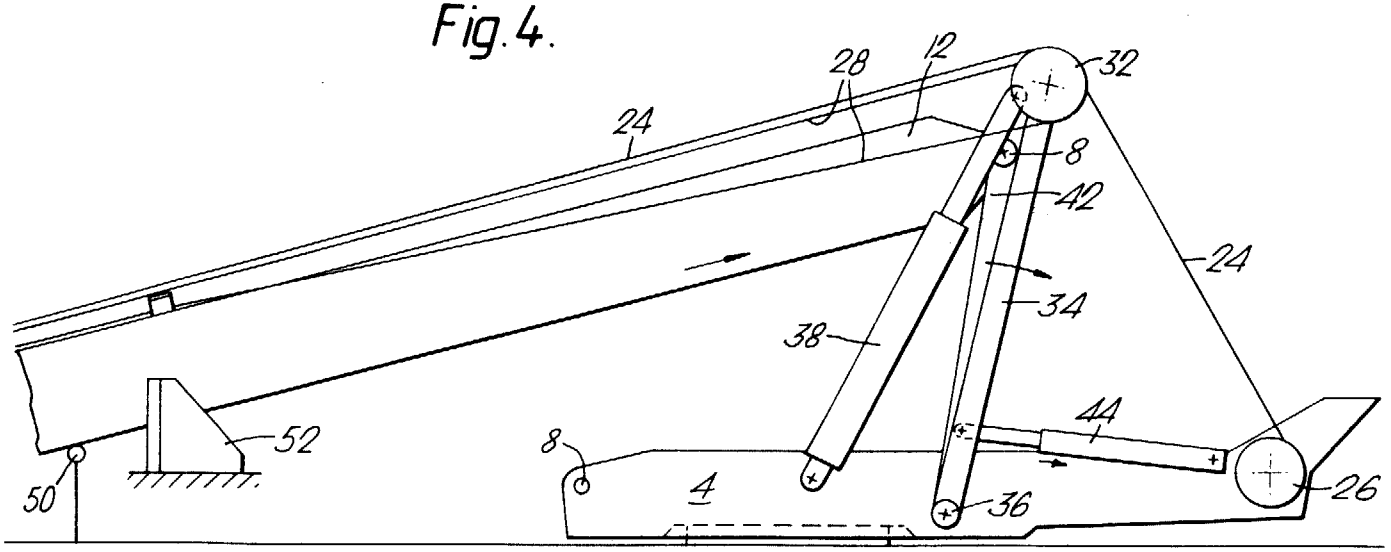
FIG. 4 is a diagram corresponding to FIG. 3 showing the jib being moved from its erected position into its stowed position.
Figure 5:
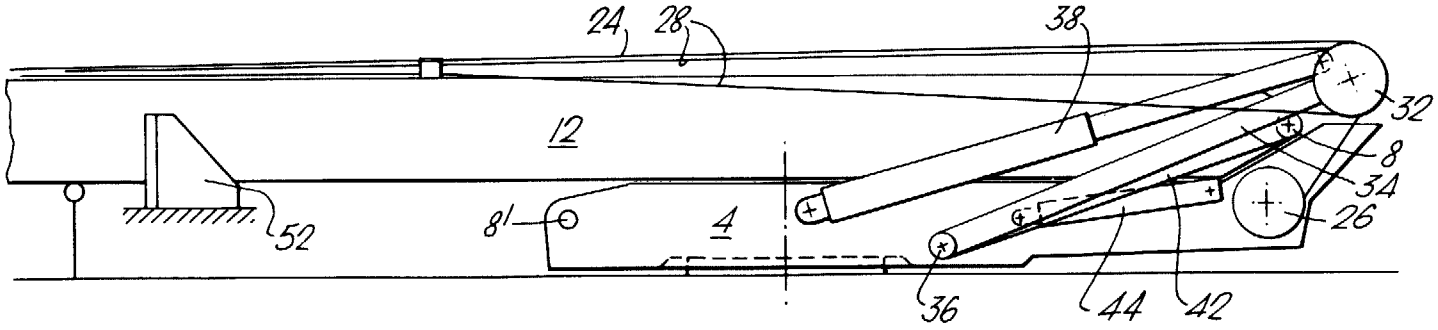
FIG. 5 is a view corresponding to FIG. 4 showing the jib in its stowed position ready for travelling.

When the sections have been telescoped into each other the pivot pin 8 connecting the foot 40 of the base section 12 to the turntable 4, is withdrawn and the ram 44 contracted so as to cause the swing link 42 to pivot about its pivot 36 in a clockwise direction as seen in the drawings, thus causing the foot of the base section 40 of the jib to swing upwardly and rearwardly over the turntable from the position shown in FIG. 3 to that shown in FIG. 4 until finally the "stowed" position in FIG. 5 is reached.

During this movement, the ram 38 of the derrick mast 34 is also operated to keep the tie ropes taut whilst controlling the movement of the head of the telescoped jib. The final position of the mast being that shown in FIG. 5 (and FIG. 2) at which point the ram 38 is extended somewhat to tauten the tie ropes 28 and to hold the mast and jib securely in the stowed position.

During the movement of the jib, the head of the telescopic sections when, for example, in the position shown in FIG. 4 would tend to foul the front of the crane vehicle and in order to obviate this, a hydraulic crane rest 50 is provided which is extended to engage the head of the jib to keep this sufficiently high above the vehicle to prevent fouling. At a later stage during the swing movement, the rest is lowered to move the jib into the position shown in FIG. 5 in which it is fully supported by the member 50 when this member is in its retracted "rest" position.

When in the stowed position, it will be seen from FIG. 2, that the telescoped jib sections extend forwardly and rearwardly beyond the confines of the vehicle. However, the overhang at each end is within permitted limits. Before movement of the vehicle, the counterweight can be detached from the rear of the turntable and secured at 52 on the vehicle and the crane hook 54 can also be securely attached to the front of the vehicle with the lifting ropes 24 being tightened to ensure good tight stowage.

The crane can then readily be moved to a new site.

After arriving at a new site, the counterweight is again attached to the rear of the turntable, the crank hook is released and the ram 44 operated to swing the link 42 forward to the operating position shown in FIGS. 1 and 3 in which the foot of the base section 12 of the jib can again be pivotally pinned at 8. The jib sections can then be extended outwardly and pinned in their new position with the crane quickly made ready for use without having to employ special crane erectors.

I claim:

1. A vehicle mounted mobile crane comprising:

a variably extendible telescopic jib having at least head and base sections, the foot of said base section releasably pivotally mounted to a first point at a first and forward position on the vehicle;

a swing link pivotally connected at a first end to the foot of said base section and at a second end to a second point at a second position on the vehicle;

means for swinging said swing link and the foot of said base section therewith about said second end to a third and rearward position on the vehicle so as to stow said jib, said foot and first end rising during swinging movement between said first and third positions;

said second position being intermediate said first and third positions;

a derrick mast pivotally mounted at one end at the second position on the vehicle;

pulleys mounted to the top of said head section and to the outer end of said derrick mast;

a fixed length tie rope passed around said pulleys so as to support the jib head a fixed distance from the outer end of the derrick mast; and luffing means for angularly positioning said derrick mast acting between the mast and vehicle whereby the jib may be luffed when the base section is pivoted at the first position and whereby the mast and jib can be closely stowed when the base section is moved to the third position.

2. The mobile crane of claim 1 further comprising a rotatable turntable on which the foot of said base section is releasably pivotally mounted to which said swing link and mast are mounted at said second position.

3. The mobile crane of claim 2 further comprising an adjustable height jib support means mounted on the vehicle

4. The mobile crane of claim 1 wherein said swinging means includes a ram coupled to said swing link and acting between said swing link and vehicle.

5. The mobile crane of claim 1 wherein said luffing means is a ram pivotally mounted to said mast and acting between the mast and the vehicle at a fourth position.

6. The mobile crane of claim 5 wherein said fourth position is between said first and second positions.

7. A vehicle mounted mobile crane comprising:

a variably extendible telescopic jib having at least head and base sections, the foot of said base section releasably pivotally mounted to a first point at a first and forward position on the vehicle;

a swing link pivotally connected at a first end to the foot of said base section and at a second end at a second position on the vehicle;

means pivotably connected to said swing link between said first and second ends and also to the vehicle at a fourth position rearwardly of the second position for swinging said swing link and the foot of said base section therewith about said second end to a third and rearward position on the vehicle so as to stow said jib, said foot and first end rising during swinging movement between said first and third positions;

said second position being intermediate said first and third positions;

a derrick mast pivotally mounted at one end at a fifth position on the vehicle;

pulleys mounted to the top of said head section and to the outer end of said derrick mast;

a fixed length tie rope passed around said pulleys so as to support the jib head a fixed distance from the outer end of the derrick mast; and luffing means for angularly positioning said derrick mast acting between the mast and vehicle whereby the jib may be luffed when the base section is pivoted at the first position and whereby the mast and jib can be closely stowed when the base section is moved to the third position.

8. The mobile crane of claim 7 further comprising a rotatable turntable on which the foot of said base section is releasably pivotally mounted to which said swing link and mast are mounted at said second position.

9. The mobile crane of claim 7 wherein said luffing means is a ram pivotally mounted to said mast and acting between the mast and the vehicle at a sixth position.

10. The mobile crane of claim 9 wherein said sixth position is between said first and second positions.

11. The mobile crane of claim 7 further comprising an adjustable height jib support means mounted on the vehicle for supporting said jib when said jib is being luffed and when stowed.

12. A vehicle mounted mobile crane comprising:

a variably extendable telescopic jib having at least head and base sections, the foot of said base section releasably pivotally mounted to a first point at a first and forward position on the vehicle;

a swing link pivotally connected at a first end to the foot of said base section and at a second end to a second point at a second position on the vehicle;

means for swinging said swing link and the foot of said base section therewith about said second end to a third and rearward position on the vehicle so as to stow said jib, said foot and first end rising during swinging movement between said first and third positions;

said second position being intermediate said first and third positions;

a derrick mast pivotally mounted at one end at a fourth position on the vehicle;

pulleys mounted to the top of said head section and to the outer end of said derrick mast;

a fixed length tie rope passed around said pulleys so as to support the jib head a fixed distance from the outer end of the derrick mast, and a ram pivotally mounted to said mast and acting between the mast and the vehicle at a fifth position between said first and second positions for angularly positioning said derrick mast whereby the jib may be luffed when the base section is pivoted at the first position and whereby the mast and jib can be closely stowed when the base section is moved to the third position.

13. The mobile crane of claim 12 further comprising a rotatable turntable on which the foot of said base section is releasably pivotally mounted to which said swing link and mast are mounted at said second position.

14. The mobile crane of claim 12 wherein said swinging means includes a ram coupled to said swing link and acting between said swing link and vehicle.

15. The mobile crane of claim 12 further comprising an adjustable height jib support means mounted on the vehicle for supporting said jib when said jib is being luffed and when stowed.

16. A vehicle mounted mobile crane comprising:

a variably extendible telescopic jib having at least head and base sections, the foot of said base section releasably pivotally mounted to a first point at a first and forward position on the vehicle;

a swing link pivotally connected at a first end to the foot of said base section and at a second end to a second point at a second position on the vehicle;

means for swinging said swing link and the foot of said base section therewith about said second end to a third and rearward position on the vehicle so as to stow said jib, said foot and first end rising during swinging movement between said first and third positions;

said second position being intermediate said first and third positions;

a derrick mast pivotally mounted at one end at a fourth position on the vehicle;

pulleys mounted to the top of said head section and to the outer end of said derrick mast;

a fixed length tie rope passed around said pulleys so as to support the jib head a fixed distance from the outer end of the derrick mast;

luffing means for angularly positioning said derrick mast acting between the mast and vehicle whereby the jib may be luffed when the base section is pivoted at the first position and whereby the mast and jib can be closely stowed when the base section is moved to the third position; and adjustable height jib support means mounted on the vehicle for supporting said variably extendible telescopic jib when said jib is being luffed and when stowed.

17. The mobile crane of claim 16 further comprising a rotatable turntable on which the foot of said base section is releasably pivotally mounted to which said swing link and mast are mounted at said second position.

18. The mobile crane of claim 16 wherein said swinging means includes a ram coupled to said swing link and acting between said swing link and vehicle.

19. The mobile crane of claim 16 wherein said luffing means is a ram pivotally mounted to said mast and acting between the mast and the vehicle at a fifth position.

20. The mobile crane of claim 19 wherein said fifth position is between said first and second positions.

* * * * *